United States Patent [19]

Griesinger et al.

[11] Patent Number: 4,576,000

[45] Date of Patent: Mar. 18, 1986

[54] SPINNING ROTOR FOR AN OPEN-END SPINNING DEVICE AND PROCESS OF MAKING SAME

[75] Inventors: Rolf Griesinger, Göppingen-Faurndau; Gerhard Fetzer, Süssen, both of Fed. Rep. of Germany

[73] Assignees: Hans Stahlecker, Fed. Rep. of Germany; Fritz Stahlecker, Fed. Rep. of Germany

[21] Appl. No.: 626,931

[22] Filed: Jul. 2, 1984

[30] Foreign Application Priority Data

Jul. 5, 1983 [DE] Fed. Rep. of Germany ..... 3324128

[51] Int. Cl.[4] ..... D01H 1/12

[52] U.S. Cl. ..... 57/416

[58] Field of Search ..... 57/400, 404, 414, 416

[56] References Cited

U.S. PATENT DOCUMENTS

| | | | |
|---|---|---|---|
| 3,520,122 | 7/1970 | Shepherd | 57/416 |
| 3,822,541 | 7/1974 | Croasdale | 57/416 |
| 3,943,691 | 3/1976 | Mizon et al. . | |
| 4,193,253 | 3/1980 | Herbert et al. | 57/414 |

*Primary Examiner*—Donald Watkins

*Attorney, Agent, or Firm*—Barnes & Thornburg

[57] ABSTRACT

A spinning rotor for an open-end spinning device and a method of making same is disclosed. A spinning rotor arrangement includes a shaft carrying a rotor including a sliding wall starting at one open face side of the rotor and diversing conically outward of the rotor axes. A fiber collecting groove is connected to the sliding surface and forms the greatest inner diameter portion of the rotor. The surfaces of the fiber collecting groove are hardened by a plastic deformation process.

10 Claims, 4 Drawing Figures

SPINNING ROTOR FOR AN OPEN-END SPINNING DEVICE AND PROCESS OF MAKING SAME

BACKGROUND AND SUMMARY OF THE INVENTION

The invention relates to a spinning rotor for an open-end spinning device of the type having a shaft supporting a rotor dish (rotor) and a method of making same. The rotor includes a sliding wall starting at the open face side of the rotor and widening conically in the rotor axial direction to a position where it connects with a fiber collecting groove forming the greatest inner diameter of the rotor.

The inner surfaces of spinning rotors are commonly manufactured by means of machine tool cutting operations. Since these rotor surfaces should exhibit good sliding characteristics for the fiber material to be processed, they require polishing. Usually a diamond polishing or lapping compound is utilized. The finishing of the inner surfaces, especially of the area of the fiber collecting groove, and thereby the preciseness of the shape has a great influence on the yarn being spun. On the other hand, the inner surfaces of the rotors, especially in the area of the fiber collecting groove, are to exhibit a high wear resistance so that the spinning rotor has a sufficient lifetime and retains its desired shape/form over the maximum possible running period. For this purpose, it has been contemplated to provide either rotors made of aluminum with different coatings, or steel rotors that are treated by a hardening process. In all instances, however, the service life was unsatisfactory. Furthermore, the surface finishing of the rotors was adversely affected due to this additional treatment, so that the spinning quality was compromised in favor of the increase in service life.

It is an object of this invention to provide a spinning rotor of the kind mentioned above which exhibits a high production accuracy in the area of the fiber collecting groove and an increased service life. This object is achieved according to the invention by hardening the surfaces of the fiber collecting groove by means of a plastic deformation process.

The plastic deformation of the rotor material at the surfaces of the fiber collecting grooves leads to a high measure precision in the grooves/shape and a smooth surface, while at the same time hardening the rotor material in the area of the inner surfaces of the roller. It is especially advantageous according to preferred embodiments of the invention to provide steel spinning rotors with a plastically deformed fiber collecting groove region.

In order to produce the plastic deformation of the surfaces of the fiber collecting groove, it is provided in an advantageous modification of the invention that the inner surfaces of the rotors are, subsequent to the machine tool cutting operation, exposed to a rolling or burnishing process at least in the area of the fiber collecting groove. Known burnishing processes have been utilized primarily with smooth cylindrical surfaces, especially outer cylindrical surfaces, leading to a high degree of surface finishing and a simultaneous hardening of this surface.

In order to execute the burnishing process according to a further aspect of the invention, a roller is radially pressed against the fiber collecting groove section of the rotor while the roller and rotor are rotatably driven with respect to one another. The roller has a smaller diameter than the open face side of the rotor itself and exhibits an outer profile corresponding to the desired inner profile of the fiber collecting groove in the area of the groove bottom and the adjacent surfaces. This profiled roller runs at least once over the entire circumference of the fiber collecting groove so that a uniform hardening is obtained.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWINGS

Figure 1:
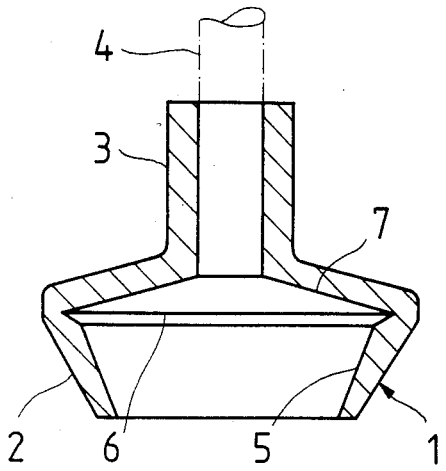
FIG. 1 is a sectional view through a rotor of a spinning rotor arrangement taken in the plane of the rotor axis.

In order not to obscure the invention, in the drawings and in the following description, only those features of a spinning rotor are shown and described as are deemed necessary for one skilled in the art to practice the invention. By way of background information the spinning rotor of this invention could be utilized on many commercially available spinning machines, such as the AUTOCORO (Registered Trademark) machine.

The spinning rotor 1 shown in FIG. 1 consists of a rotor 2, including an axial collar 3, which collar exhibits an axial bore and is pressed upon a shaft 4 indicated with dotted lines. The rotor 2 exhibits an open face side (bottom as shown in FIG. 1) at which a sliding wall 5 starts and extends conically widened to a fiber collecting groove 6. The fiber collecting groove 6 exhibits the greatest inner diameter of the rotor 2 and connects to the sliding wall 5 in the form of an undercut section. The fiber collecting groove 6 has a V-shaped cross-section whereby the surface 8 following the sliding wall 5 forms an obtuse angle with the sliding wall 5. The other surface 11 of the fiber collecting groove 6 extends into the bottom 7 of the rotor 2. During the spinning process the fiber material is opened to single fibers, supplied to sliding wall 5, and slides along this sliding wall 5 to the fiber collecting groove 6. At groove 6, the single fibers are formed to a fiber band or yarn which is continuously drawn off essentially over the open face side of the rotor 2.

The inner profile of the rotor 2, which advantageously is produced from steel, is formed by means of a machine cutting operation using a precision diamond lathe or the like. For the spinning process it is essential that the fiber collecting groove 6 is exactly of the desired form or shape and exhibits a high surface finishing.

In order to obtain these characteristics, and especially with steel rotors 2, other material cutting type polishing processes follow subsequent two the turning or cutting on the lathe.

Additionally, it is required that the rotor 2, especially in the area of the fiber collecting groove 6, exhibits a high wear resistance. For this purpose it is provided that the surfaces of the fiber collecting groove 6, namely surface 8 following the sliding wall 5, the groove bottom surface 12 and surface 11 extending and continuing into the rotor bottom 7, are plastically deformed by means of a burnishing process. With this burnishing process, the form precision in the area of the fiber collecting groove 6 is increased while, on the other hand, the surface detail is improved. Additionally, a hardenin of the surfaces is the result of the plastic deformation of surfaces 8, 11, and 12, which, especially with steel rotor 2, leads to a high wear resistance.

Figure 2:
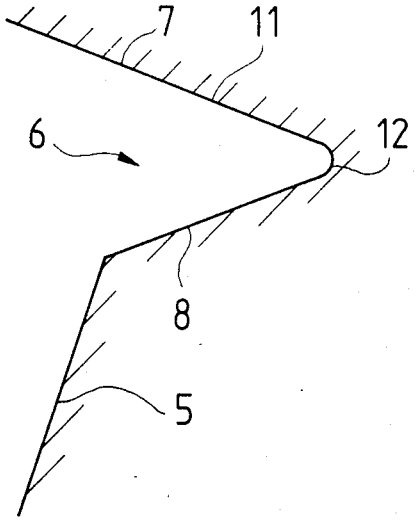
FIG. 2 is a partial, enlarged sectional view depicting a rotor in the area of the fiber collecting groove after a machine cutting process.
Figure 3:
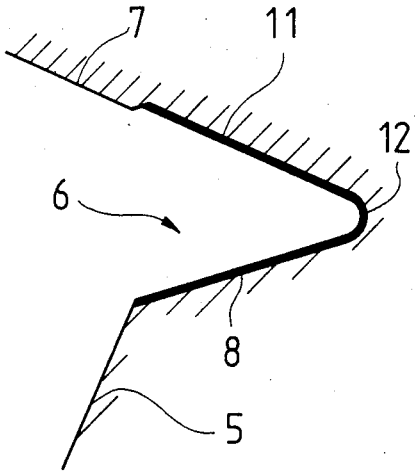
FIG. 3 is a view similar to FIG. 2, depicting the fiber collecting groove of the rotor after a plastic deformation process at the fiber collecting groove in accordance with a preferred embodiment of the invention.
Figure 4:
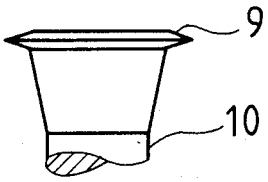
FIG. 4 is a partial side view showing a roller utilized for the plastic deformation process of the invention at the fiber collecting groove of the spinning rotor according to FIGS. 1 and 2.

The burnishing process itself is done utilizing a roller 10 corresponding to FIG. 4, which roller has a diameter which is smaller than the diameter of the open face side of the rotor 2, and thereby also of the collecting groove 6. Roller 10 includes a ring-shaped profile 9, the outer profile of which corresponds to the desired profile of the fiber collecting groove 6. Roller 10 is inserted into the rotor 2 and pressed with its ring-shaped profile 9 against the fiber collecting groove 6 prepared in accordance with FIG. 2. The rotor 2 is then rotatably driven so that roller 10 runs with its ring-shaped profile 9 over the entire circumference of the fiber collecting groove 6 and deforms surfaces 8, 11, and 12 of the collecting groove 6, thereby hardening the same. The profile 9 of roller 10 is thereby so formed and dimensioned that a ring surface 11 connected to the groove bottom 12 is coldly deformed starting from the rotor bottom 7. Said ring surface has a depth in radial direction of the rotor 2 corresponding at least approximately to the depth of surface 8 in radial direction.

It is preferred that the freely rotatable roller 10 remains stationary during the burnishing, while at the same time the rotor 2 is driven to a rotational movement. It is certainly also contemplated according to other embodiments to stationarily hold the rotor 2 and to rotatably drive the axle of the freely rotatable roller 10 to a circular motion centrically with respect to the rotor 2.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Spinning rotor construction for an open-end spinning machine including a rotor made from a plastically deformable material, comprising:

a rotor bottom, a fiber collecting groove adjoining the rotor bottom and exhibiting the maximum rotor internal diameter, said fiber collecting groove being uncoated and being made from said material, and a sliding wall commencing at an open face side of the rotor, and extending in a conically widening manner to the fiber collecting groove, wherein the surfaces of the fiber collecting groove are hardened by being plastically deformed.

2. Spinning rotor construction according to claim 1, wherein the fiber collecting groove includes three surface sections forming the shape of a V in cross-section, wherein a first of said surface sections forms one side of the V and extends at an obtuse angle from the sliding wall, wherein a second of said surface sections forms the other side of the V and extends into the rotor bottom, wherein the third of said surface sections forms the bottom of the groove and connects with the first and second surface sections, and wherein said three surface sections are hardened by a plastic deformation process.

3. Spinning rotor construction according to claim 2, wherein the radial depth of the second surface section is at least approximately corresponding to the radial depth of the first surface section continuing from the sliding wall.

4. Spinning rotor construction according to claim 1, wherein the rotor is manufactured from steel.

5. Spinning rotor construction according to claim 3, wherein the rotor is manufactured from steel.

6. Process for manufacturing a spinning rotor for open-end spinning, comprising:

forming a rotor with a rotor bottom using elastically deformable material, fiber collecting groove adjoining the rotor bottom and exhibiting the maximum rotor internal diameter, said groove being made from said material and a sliding wall commencing at an open face side of the rotor and extending in a conically widening manner to the fiber collecting groove, pre-finishing at least the interior surface of the rotor utilizing a machine tool cutting process, and subsequently subjecting the fiber collecting portion of the rotor to a plastically deforming hardening process.

7. Process for manufacturing a spinning rotor according to claim 6, wherein the plastically deforming hardening process includes burnishing of the fiber collecting groove portion of the rotor.

8. Process for manufacturing a spinning rotor according to claim 7, wherein for the burnishing process a roller is radially pressed against the fiber collecting groove, said roller having a smaller diameter than the open face side of the rotor and exhibiting an outer profile corresponding to the desired inner profile of the fiber collecting groove in the area of the groove bottom and the connecting surfaces.

9. Process for manufacturing a spinning rotor according to claim 6, wherein the fiber collecting groove includes three surface sections forming the shape of a V in cross-section, wherein a first of said surface sections forms one side of the V and extends at an obtuse angle from the sliding wall, wherein a second of said surface sections forms the other side of the V and extends into the rotor bottom, wherein the third of said surface sections forms the bottom of the groove and connects with the first and second surface sections, and wherein said three surface sections are hardened by a plastic deformation process.

10. Process for manufacturing a spinning rotor according to claim 9, wherein the radial depth of the second surface section is at least approximately corresponding to the radial depth of the first surface section continuing from the sliding wall.

* * * * *